US011382414B1

(12) United States Patent
Zhang et al.

(10) Patent No.: US 11,382,414 B1
(45) Date of Patent: Jul. 12, 2022

(54) ADJUSTABLE DESK EASY TO DISASSEMBLE

(71) Applicant: NINGBO HUIWUZHOU INTELLIGENT TECHNOLOGY CO., LTD., Ningbo (CN)

(72) Inventors: Bo Zhang, Ningbo (CN); Hongbin Lu, Ningbo (CN); Jinyi Li, Ningbo (CN); Enjie Ruan, Ningbo (CN); Xingliang Chen, Ningbo (CN)

(73) Assignee: NINGBO HUIWUZHOU INTELLIGENT TECHNOLOGY CO., LTD., Ningbo (CN)

( * ) Notice: Subject to any disclaimer, the term of this patent is extended or adjusted under 35 U.S.C. 154(b) by 0 days.

(21) Appl. No.: 17/318,429

(22) Filed: May 12, 2021

(30) Foreign Application Priority Data

Jan. 19, 2021 (CN) ..... 202110067092.5

(51) Int. Cl.
*A47B 3/08* (2006.01)
*A47B 3/06* (2006.01)
*A47B 1/08* (2006.01)

(52) U.S. Cl.
CPC ..... *A47B 3/0818* (2013.01); *A47B 1/08* (2013.01); *A47B 3/06* (2013.01); *A47B 2200/0056* (2013.01)

(58) Field of Classification Search
CPC ..... A47B 3/02; A47B 3/0818; A47B 3/08; A47B 3/06; A47B 2200/0056; A47B 1/08
See application file for complete search history.

(56) References Cited

U.S. PATENT DOCUMENTS

| | | | | |
|---|---|---|---|---|
| 2017/0224101 | A1* | 8/2017 | Bruder | A47B 13/06 |
| 2018/0110324 | A1* | 4/2018 | Keller | A47B 9/14 |
| 2020/0154876 | A1* | 5/2020 | Liu | A47B 9/00 |
| 2021/0100355 | A1* | 4/2021 | Jørgensen | A47B 9/04 |
| 2021/0100356 | A1* | 4/2021 | Huang | A47B 17/02 |

FOREIGN PATENT DOCUMENTS

| | | |
|---|---|---|
| CN | 205696563 U | 11/2016 |
| CN | 212855847 U | 4/2021 |

* cited by examiner

*Primary Examiner* — Daniel J Rohrhoff
(74) *Attorney, Agent, or Firm* — Innovation Capital Law Group, LLP; Vic Lin

(57) ABSTRACT

An adjustable desk easy to disassemble comprises: a crossbeam used as a bearing structure of the adjustable desk; two desk legs disposed at two ends of the crossbeam, pivotably connected to the crossbeam and used to stabilize relative positions of the desk legs and the crossbeam through first locking parts; and two brackets disposed at the two ends of the crossbeam, fixed to the crossbeam through second locking parts. When the adjustable desk needs to be assembled or disassembled, the first locking parts and the second locking parts are removed to allow the two desk legs to rotate towards or opposite to each other to complete assembly or disassembly of the adjustable desk.

13 Claims, 7 Drawing Sheets

ADJUSTABLE DESK EASY TO DISASSEMBLE

BACKGROUND OF THE INVENTION

1. Technical Field

The invention belongs to the technical field of adjustable office desks, and relates to an adjustable desk, in particular to an adjustable desk easy to disassemble.

2. Description of Related Art

Electric adjustable desks can be used by people of different heights because of their adjustable height, and typically comprise a crossbeam, and desk legs and brackets connected to two ends of the crossbeam, wherein the desk legs are detachably connected to the crossbeam, and the brackets are also detachably connected to the crossbeam. When the adjustable desk is to be assembled, the components are assembled on the crossbeam one by one. When the adjustable desk is to be disassembled, the components are disassembled from the crossbeam one-by-one. So, the operation steps are complicated, and it takes a long time to assemble and disassemble the adjustable desk.

BRIEF SUMMARY OF THE INVENTION

The objective of the invention is to solve the above-mentioned problems of the prior art by providing an adjustable desk easy to disassemble to improve the disassembly efficiency of the adjustable desk.

The objective of the invention is realized through the following technical solution:

an adjustable desk easy to disassemble, comprising:

a crossbeam used as a bearing structure of an adjustable desk;

two desk legs disposed at two ends of the crossbeam, pivotably connected to the crossbeam and used to stabilize relative positions of the desk legs and the crossbeam through first locking parts; and two brackets disposed at the two ends of the crossbeam, and fixed to the crossbeam through second locking parts, wherein when the adjustable desk needs to be assembled or disassembled, the first locking parts and the second locking parts are removed to allow the two desk legs to rotate towards or opposite to each other to complete assembly or disassembly of the adjustable desk.

According to an adjustable desk easy to disassemble, the two desk legs are cross-stacked in an initial state.

According to an adjustable desk easy to disassemble, the first locking parts overlap with the second locking parts after the adjustable desk is assembled.

According to an adjustable desk easy to disassemble, first locking holes are formed in the crossbeam, second locking holes are formed in the brackets, and screws are screwed on the desk legs; the first locking holes are matched with the screws to form the first locking parts between the crossbeam and the desk legs, and the second locking holes are matched with the screws to form the second locking parts between the brackets and the crossbeam.

According to an adjustable desk easy to disassemble, an end of each said first locking hole and an end of each said second locking hole are open, and another end of each said first locking hole and another end of each said locking hole are closed; and after the adjustable desk is assembled, the first locking holes and the second locking holes are open towards the desk legs.

According to an adjustable desk easy to disassemble, corners of the crossbeam are wrapped in the brackets and the second locking holes are farther away from the desk legs than the first locking holes and are counter bores.

According to an adjustable desk easy to disassemble, each said bracket comprises a horizontal plate and a vertical plate the horizontal plates are inserted into and matched with the crossbeam, and the second locking holes are located in the vertical plates.

According to an adjustable desk easy to disassemble, insertion plates are mounted on the horizontal plates, guide slots are formed in the crossbeam, and the insertion plates are inserted into the guide slots to enable the brackets to be inserted into and matched with the crossbeam.

According to an adjustable desk easy to disassemble, notches allowing the horizontal plates to be mounted therein are formed in openings of the guide slots.

According to an adjustable desk easy to disassemble, connecting plates are disposed at the two ends of the crossbeam, a side of each said connecting plate is provided with a guide surface and is connected to the corresponding slot, and another side of each said connecting plate is formed with one said first locking hole; and after the insertion plates are inserted into the guide slots along the guide surfaces, the horizontal plates are flush with a surface, away from the desk legs, of the crossbeam.

According to an adjustable desk easy to disassemble, a mounting cavity is formed in the crossbeam in a lengthwise direction, and the two desk legs are rotatably connected to two ends of the mounting cavity, respectively.

According to an adjustable desk easy to disassemble, a motor housing which is embedded in the mounting cavity and rotatably connected to a cavity wall of the mounting cavity is disposed at an end of each said desk leg; and the motor housings are connected to the cavity wall of the mounting cavity through pins, and the screws are mounted on the motor housings.

According to an adjustable desk easy to disassemble, adjusting holes corresponding to the pins in position are formed in the crossbeam.

According to an adjustable desk easy to disassemble, the crossbeam comprises a plurality of telescopic tubes, each of which is formed by bending a metal sheet, and every two adjacent said telescopic tubes are detachably connected.

According to an adjustable desk easy to disassemble, a reinforcing plate is disposed at the joint of two connected telescopic tubes, wherein a closed end of the reinforcing plate is flush with a plane where a horizontal plate is located.

Compared with the prior art, the invention has the following beneficial effects:

(1) According to the adjustable desk easy to disassemble of the invention, the adjustable desk can be easily assembled and disassembled by rotating two desk legs towards or opposite to each other by means of first locking parts and second locking parts, and the assembly and disassembly efficiency of the adjustable desk is improved.

(2) Screws between a crossbeam and the desk legs are shared by brackets and the crossbeam, so that fixing positions between the crossbeam and the desk legs overlap with fixing positions between the brackets and the crossbeam; and the crossbeam, the desk legs and the brackets can be fixed and disassembled synchronously by rotating the screws, so that the disassembly efficiency of the adjustable desk is further improved.

(3) First locking holes and second locking holes are of the semi-open structure, so that when the desk legs are unfolded or folded, the screws screwed on the desk legs can be synchronously clamped into or slid out of the first locking holes and the second locking holes along with the rotation of the desk legs, and thus, the crossbeam and the desk legs can be connected easily, and the brackets and the crossbeam can be connected easily. Moreover, both the first locking holes and the second locking holes are open towards the desk legs after the adjustable desk is assembled, and the screws are clamped in and matched with the closed ends of the first locking holes and the closed ends of the second locking holes after the adjustable desk is assembled, so the bearing capacity of the adjustable desk is further improved.

(4) The corners of the crossbeam are wrapped in the brackets, so that both ends and the corners of the crossbeam are protected; in addition, the second locking holes are counter bores, so that the end faces of the screws are flush with the surfaces of the brackets when the screws are tightened, and thus, the appearance of the lifting desk is improved.

(5) Horizontal plates are inserted into and matched with the crossbeam, so that the brackets are accurately positioned when connected to the crossbeam, it is ensured that the second locking holes are coaxial with the first locking holes, the screws can be synchronously clamped into or slid out of the first locking holes and the second locking holes, the crossbeam, the desk legs and the brackets can be fixed and disassembled rapidly, and thus, the assembly and disassembly efficiency of the adjustable desk is further improved.

(6) The brackets can be horizontally pushed to insert insertion plates into guide slots through the guide surfaces, so that the connection firmness between the brackets and the crossbeam is guaranteed. In addition, connecting plates are arranged, so that it is ensured that horizontal plates are flush with the crossbeam when the insertion plates are inserted into the guide slots, in this way, the contact area of a desk board with the brackets and the crossbeam is enlarged, the bearing capacity of the whole adjustable desk is improved, and the levelness of the adjustable desk is guaranteed after installation.

(7) The crossbeam is divided into a plurality of telescopic tubes, so that the manufacturing process and manufacturing cost of the crossbeam are reduced; and on the other hand, the length of the crossbeam can be adjusted to adjust the dimensions of the adjustable desk, so that users can select the dimensions of the desk according to personnel requirements.

In the figures: 100, crossbeam; 110, first locking hole; 120, guide slot; 130, mounting cavity; 140, pin; 150, adjusting hole; 160, telescopic tube; 170, connecting plate; 171, guide surface; 180, notch; 190, reinforcing plate; 200, desk leg; 210, screw; 220, motor housing; 300, bracket; 310, second locking hole; 320, horizontal plate; 330, vertical plate; 340, insertion plate.

DETAILED DESCRIPTION OF THE INVENTION

The technical solution of the invention will be further described below in conjunction with the specific embodiments and accompanying drawings of the invention. However, the invention is not limited to these embodiments.

It should be noted that all directional indications (such as "above" "upper", "lower", "left", "right", "front" and "back") in the embodiments of the invention are merely used to explain relative positional relations and motions of elements at a specific pose (as shown in the figures). If the specific pose changes, the directional indications will change accordingly.

Figure 1:
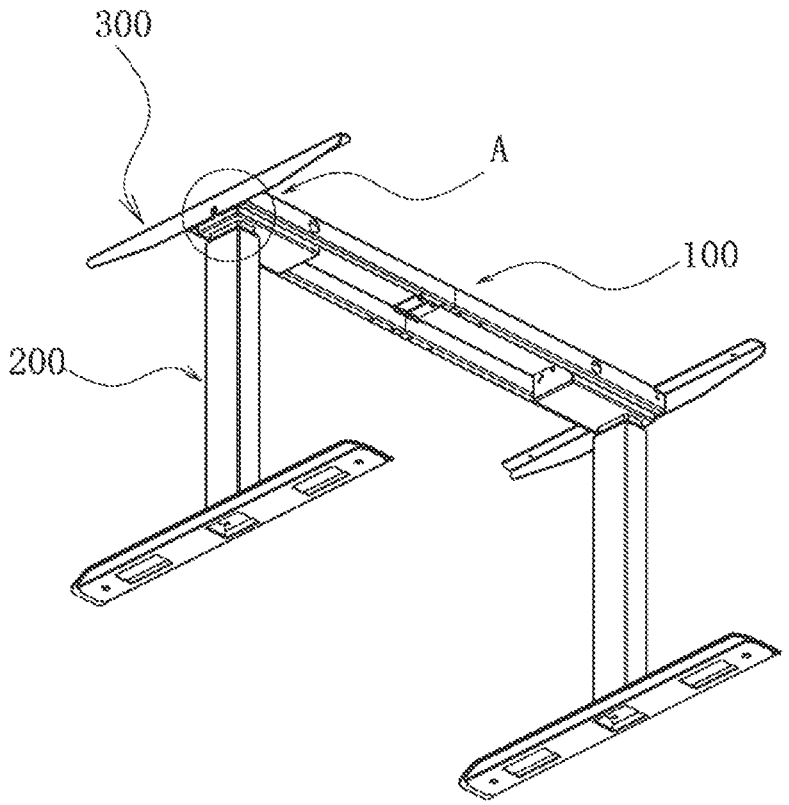
FIG. 1 is a structural view of an adjustable desk easy to disassemble according to the invention in an unfolded state.
Figure 2:
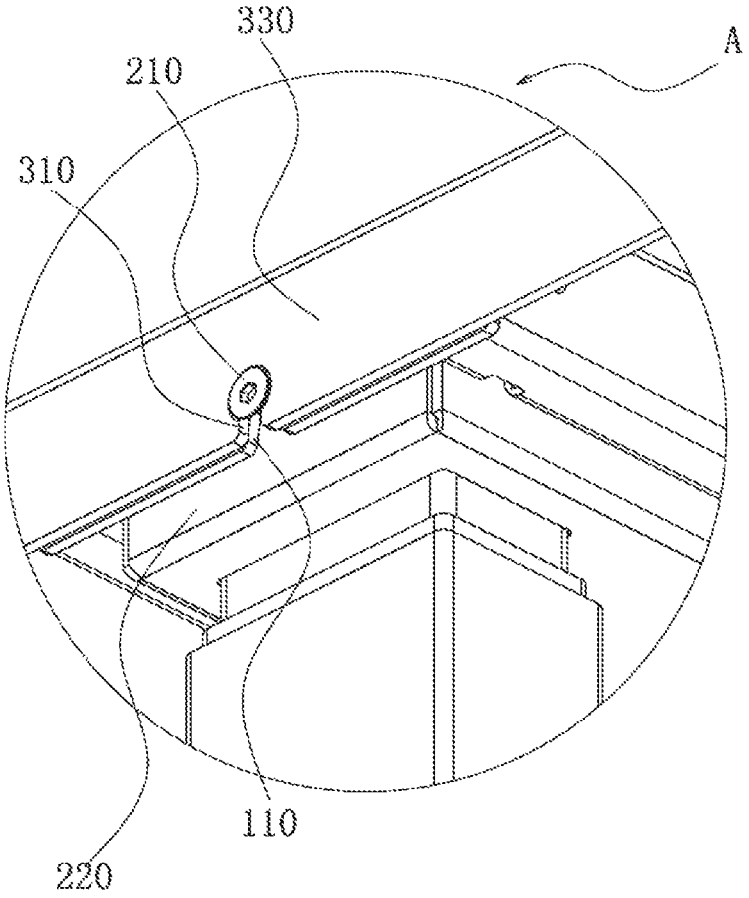
FIG. 2 is an enlarged structural view of part A in FIG. 1.
Figure 3:
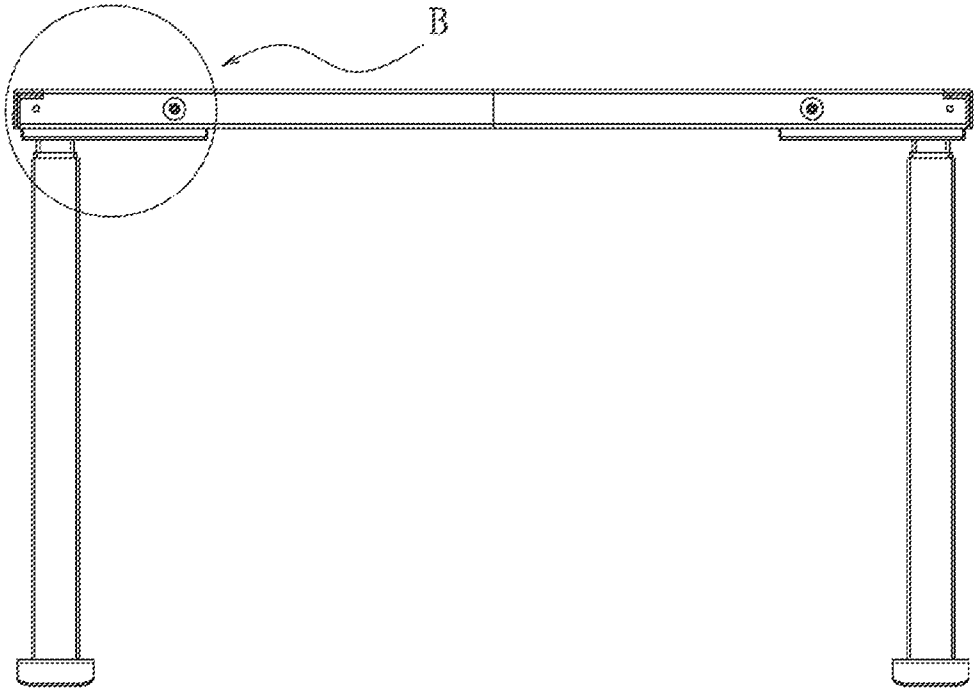
FIG. 3 is a structural view from another perspective view of the adjustable desk easy to disassemble according to the invention in an unfolded state.
Figure 4:
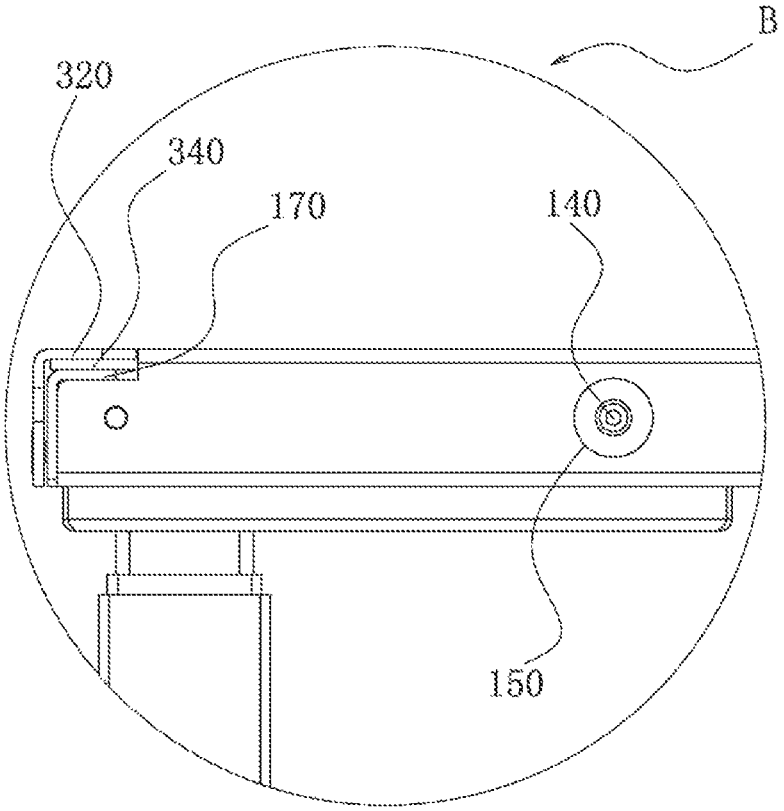
FIG. 4 is an enlarged structural view of part B in FIG. 3.
Figure 5:
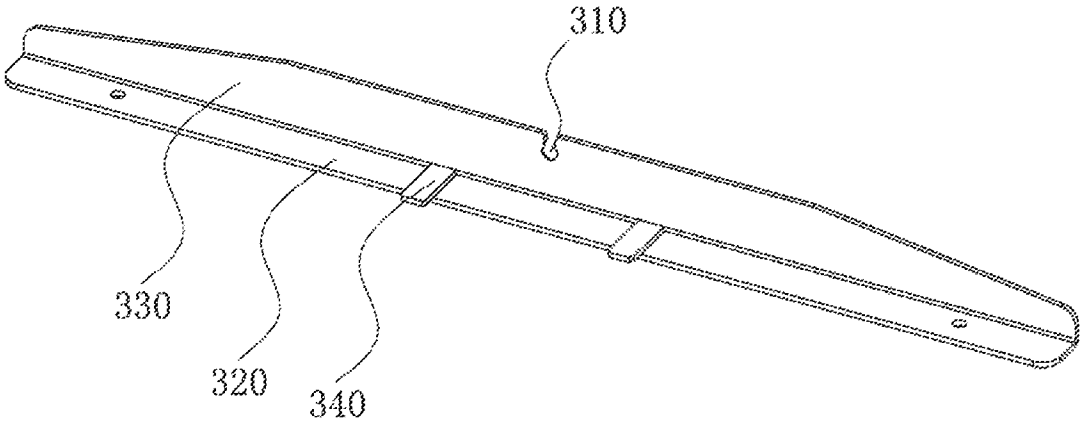
FIG. 5 is a structural view of a bracket in a preferred embodiment of the invention.
Figure 6:
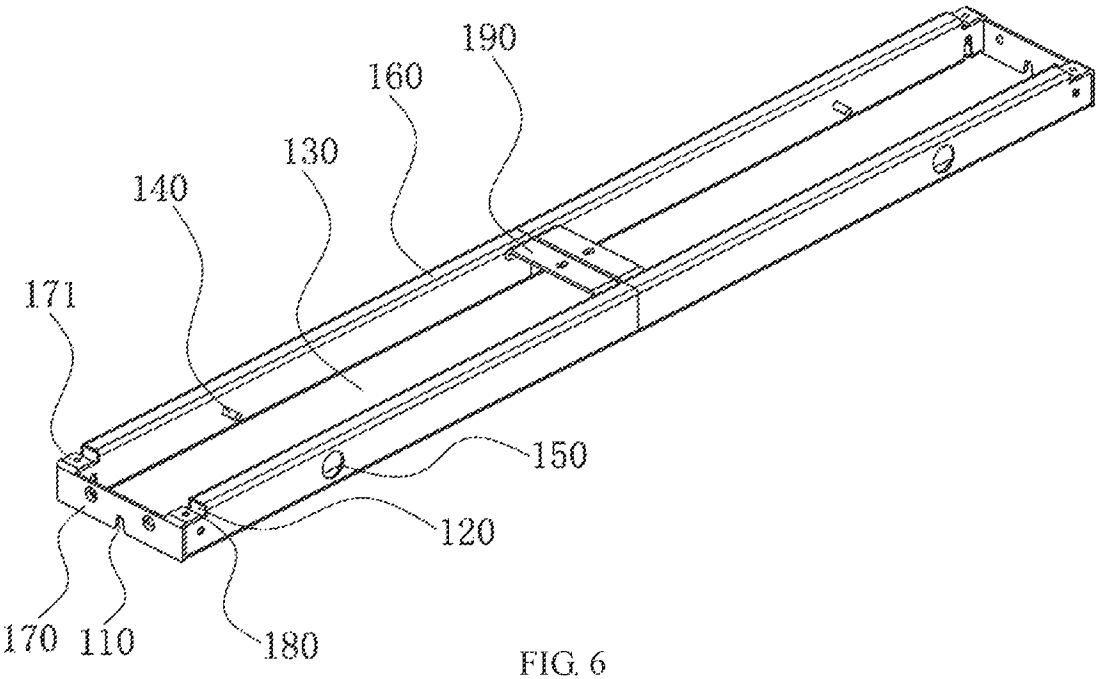
FIG. 6 is a structural view of a crossbeam in a preferred embodiment of the invention.
Figure 7:
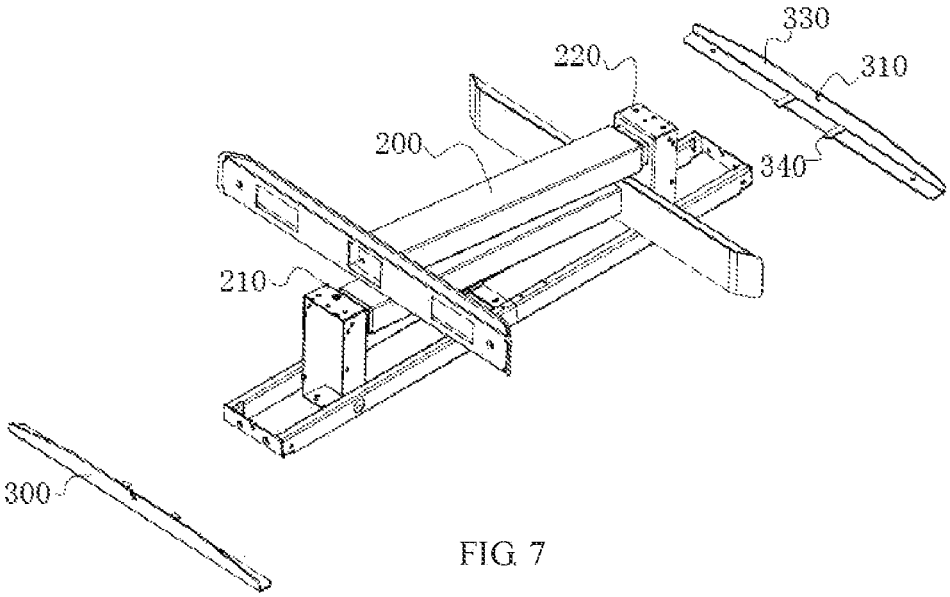
FIG. 7 is a partially exploded view of an adjustable desk easy to disassemble of the present invention in an initial state.

As shown in FIG. 1 to FIG. 6, the invention provides an adjustable desk easy to disassemble. The adjustable desk easy to disassemble comprises: a strip-shaped crossbeam 100 used as a bearing structure of the adjustable desk; two desk legs 200 disposed at two ends of the crossbeam 100, pivotably connected to the crossbeam 100 and used to stabilize relative positions of the desk legs 200 and the crossbeam 100 through first locking parts; and two brackets 300 disposed at the two ends of the crossbeam 100, located above the corresponding desk legs 200, and fixed to the crossbeam 100 through second locking parts. When the adjustable desk needs to be disassembled, the first locking parts and the second locking parts are removed, and then the two desk legs 200 are rotated towards each other, so that the adjustable desk is stored.

According to the adjustable desk easy to disassemble of the invention, the adjustable desk can be easily assembled and disassembled by rotating the two desk legs 200 towards or opposite to each other by means of the first locking parts and the second locking parts, and the assembly and disassembly efficiency of the adjustable desk is improved.

To further improve the disassembly efficiency of the adjustable desk, the first locking parts may overlap with the second locking parts.

Further preferably, first locking holes 110 are formed in the crossbeam 100, second locking holes 310 are formed in the brackets 300, and screws 210 are screwed on the desk legs 200; wherein, the first locking holes 110 are matched with the screws 210 to form the first locking parts between the crossbeam 100 and the desk legs 200, and the second locking holes 310 are matched with the screws 210 to form the second locking parts between the brackets 300 and the crossbeam 100.

In this embodiment, the screws 210 between the crossbeam 100 and the desk legs 200 are shared by the brackets 300 and the crossbeam 100, so that fixing positions between the crossbeam 100 and the desk legs 200 overlap with fixing positions between the brackets 300 and the crossbeam 100; and the crossbeam 100, the desk legs 200 and the brackets 300 can be fixed and disassembled synchronously by rotating the screws 210, so that the disassembly efficiency of the adjustable desk is further improved.

Because of the small size of the screws 210, the screws 210 may be lost if they are stored separately after being disassembled from the desk legs 200 when the adjustable desk is not used (in a folded state), so a better method for storing the screws 210 is to keep then screwed on the desk legs 200 all the time. However, if the screws 210 are always screwed on the desk legs 200, the crossbeam 100 will be connected to the desk legs 200; or, when the brackets 300 are connected to the crossbeam 100, the screws 210 need to be unscrewed at first and are then screwed on the desk legs 200 via the first locking holes 110 and the second locking holes 310, which will take a long time; and when the adjustable desk is assembled and disassembled, the screws 210 have to be placed aside, which is not beneficial to assembly and disassembly.

So, to further improve the assembly and disassembly efficiency of the adjustable desk, the first locking holes 110 and the second locking holes 310 are of a semi-open structure, that is, one end of each first locking hole 110 and one end of each second locking hole 310 are closed, and the other end of each first locking hole 110 and the other end of each second locking hole 310 are open. Wherein, after the adjustable desk is assembled, both the first locking holes 110 and the second locking holes 310 are open toward the desk legs 200.

In this embodiment, the first locking holes 110 and the second locking holes 310 are of the semi-open structure, so that when the desk legs 200 are unfolded or folded, the screws 210 screwed on the desk legs 200 can be synchronously clamped into or slid out of the first locking holes 110 and the second locking holes 310 along with the rotation of the desk legs 200, and thus, the crossbeam 100 and the desk legs 200 can be connected easily, and the brackets 300 and the crossbeam 100 can be connected easily. Moreover, both the first locking holes 110 and the second locking holes 310 are open towards the desk legs 200 after the adjustable desk is assembled, and the screws 210 are clamped in and matched with the closed ends of the first locking holes 110 and the closed ends of the second locking holes 310 after the adjustable desk is assembled, so the bearing capacity of the adjustable desk is further improved.

Preferably, corners of the crossbeam 100 are wrapped in the brackets 300, wherein the second locking holes 310 are farther away from the desk legs 200 than the first locking holes 110, and the second locking holes 310 are counter bores.

In this embodiment, the corners of the crossbeam 100 are wrapped in the brackets 300, so that both ends and the corners of the crossbeam 100 are protected; in addition, the second locking holes 310 are counter bores, so that the end faces of the screws 210 are flush with the surfaces of the brackets 300 when the screws 210 are tightened, and thus, the appearance of the lifting desk is improved.

Further preferably, the brackets 300 are L-shaped and each comprise a horizontal plate 320 and a vertical plate 330, wherein the horizontal plates 320 are inserted into and matched with the crossbeam 100, and the second locking holes 310 are located in the vertical plates 330.

In this embodiment, the horizontal plates 320 are inserted into and matched with the crossbeam 100, so that the brackets 300 are accurately positioned when connected to the crossbeam 100, it is ensured that the second locking holes 310 are coaxial with the first locking holes 110, the screws 210 can be synchronously clamped into or slid out of the first locking holes 110 and the second locking holes 310, the crossbeam 100, the desk legs 200 and the brackets 300 can be fixed and disassembled rapidly, and thus, the assembly and disassembly efficiency of the adjustable desk is further improved.

Further preferably, insertion plates 340 are mounted on the horizontal plates 320, and guide slots 120 are formed in the crossbeam 100, wherein the insertion plates 340 are inserted into the guide slots 120 to enable the brackets 300 to be inserted into and matched with the crossbeam 100.

In this embodiment, the insertion plates 340 are mounted on the horizontal plates 320, so that the thickness of the horizontal plates 320 is increased, it is ensured that the horizontal plates 320 of the brackets 300 are located on the same plane as the crossbeam 100 after the brackets 300 are connected to the crossbeam 100, in this way, the contact area of a desk board with the brackets 300 and the crossbeam 100 is enlarged, and the bearing capacity of the whole adjustable desk is improved; in addition, to guarantee the levelness of the adjustable desk after installation, notches 180 are formed in openings of the guide slots 120 of the crossbeam 100 to allow the horizontal plates 320 of the brackets 300 to be mounted therein.

Preferably, the crossbeam 100 is a frame structure formed by bending a metal sheet, and a mounting cavity 130 is formed in the crossbeam 100 in a lengthwise direction of the crossbeam 100; wherein, the two desk legs 200 are mounted at two ends of the mounting cavity 130 respectively to be inserted into and matched with the crossbeam 100, and thus, the degree of freedom of the desk legs 200 in the vertical direction of the horizontal plane is limited.

Further preferably, a motor housing 220 which is embedded in the mounting cavity 130 and is rotatably connected to a cavity wall of the mounting cavity 130 is disposed at one end of each desk leg 200 and is connected to the cavity wall of the mounting cavity 130 through a pin 140, and the screws 210 are mounted on the motor housings 220. One the one hand, the two desk legs 200 can be rotated towards or opposite to each other through the pins 140; and on the other hand, the degree of freedom of the desk legs 200 in the horizontal direction of the horizontal plane is limited by the pins 140.

Further preferably, to allow the tightness of the motor housings 220 and the crossbeam 100 to be adjusted easily to avoid the situation where the desk legs 200 rotate when the adjustable desk is assembled or disassembled due to the fact that the pins 140 are too tight or the situation where the motor housings 220 shake in the mounting cavity 130 due to the fact that the pins 140 are too loose, adjusting holes 150 are formed in the crossbeam 100 and correspond to the pins 140 in position, so that users can rotate the pins 140 correspondingly through the adjusting holes 150 to adjust the tightness of the motor housings 220 and the crossbeam 100.

Preferably, because of the large horizontal span of the crossbeam 100, if the crossbeam 100 is integrally formed by bending, the manufacturing difficulty of the crossbeam 100 will be increased, and the manufacturing cost of the crossbeam 100 will be increased. In view of this, the crossbeam 100 is divided into a plurality of telescopic tubes 160, each of which is formed by bending a metal sheet, wherein every two adjacent telescopic tubes 160 are detachably connected. By dividing the crossbeam 100 into a plurality of telescopic tubes 160, the manufacturing process and manufacturing cost of the crossbeam 100 are reduced; and on the other hand, the length of the crossbeam 100 can be adjusted to adjust the dimensions of the adjustable desk, so that users can select the dimensions of the desk according to personnel requirements.

Further preferably, connecting plates 170 are mounted at the ends, close to the motor housings 220, of the telescopic tubes 160 and are of an L-shaped structure, wherein one side of each connecting plate 170 is provided with a guide surface 171 and is connected to the corresponding notch 180, and the first locking holes 110 are located in the other side of the connecting plates 170.

In this embodiment, the brackets 300 can be horizontally pushed to insert the insertion plates 340 into the guide slots 120 through the guide surfaces 171, so that the connection firmness between the brackets 300 and the crossbeam 100 is guaranteed.

The crossbeam 100 is divided into a plurality of telescopic tubes 160 and every two adjacent telescopic tubes 160 are detachably connected, so that the strength of the crossbeam 100 is reduced to some extent. In order to improve the strength of the crossbeam 100 to prevent the middle of the crossbeam 100 from bending, a reinforcing plate 190 is mounted at the joint of every two adjacent telescopic tubes 160 and is of a U-shaped structure, wherein closed ends of the reinforcing plates 190 are flush with the horizontal plates 320.

The operating principle of the adjustable desk easy to disassemble of the invention is as follows: in general conditions, the motor housings 220 in the desk legs 200 are always rotatably connected to the crossbeam 100, so the two desk legs 200 at the two ends of the crossbeam 100 are cross-stacked in an initial state; when the adjustable desk needs to be assembled, the crossbeam 100 is turned to face downwards at first, and the two cross-stacked desk legs 200 face upwards; then, the users pull one desk leg 200 to enable the desk leg 200 to rotate around the pin 140, and when the desk leg 200 is rotated by a certain angle and the screw 210 on the motor housing 220 has not been clamped in the first locking hole 110 in the crossbeam 100, the insertion plate 340 on the bracket 300 is inserted into the guide slot 120 along the connecting plate 170, and at this moment, the second locking hole 310 in the bracket 300 is coaxial with the first locking hole 110; the desk leg 200 is further rotated to enable the screw 210 to be synchronously clamped in the first locking hole 110 and the second locking hole 310, and finally, the screw 210 is rotated with a tool to fixedly connect the crossbeam 100, the desk leg 200 and the bracket 300; and finally, the adjustable desk is assembled.

It should be noted that descriptive terms such as "first" and "second" involved in the invention are only used for the purpose of description and should not be construed as indicating or implying relative importance or implicitly indicating the number of technical features referred to. Thus, a feature defined by "first" or "second" may explicitly or implicitly refer to the inclusion of at least one said feature. Unless otherwise clearly and specifically defined, "a plurality of" in the description of the invention refers to at least two, such as two or three. Unless otherwise clearly defined, terms such as "connect" and "fix" should be broadly understood. For example, "fix" may refer to fixed connection, detachable connection or integrated connection, or mechanical connection or electrical connection, or direct connection or indirect connection via an intermediate medium, or internal communication or interaction of two elements. Those ordinarily skilled in the art can appreciate the specific meanings of these terms in the invention as the case may be.

In addition, the technical solutions of the embodiments of the invention can be combined as long as the combinations can be realized by those ordinarily skilled in the art. When the combinations of the technical solutions conflict or cannot be realized, these combinations should be regarded as not existing and are not within the protection scope of the invention.

The specific embodiments described in the specification are merely illustrative ones for explaining the spirit of the invention. Those skilled in the art can make different amendments, supplements, or similar substitutions to these specific embodiments without departing from the spirit or going beyond the scope defined by the appended claims.

What is claimed is:

1. An adjustable desk easy to disassemble, comprising:

a crossbeam (100) used as a bearing structure of an adjustable desk;

two desk legs (200) disposed at two ends of the crossbeam (100), pivotably connected to the crossbeam (100) and used to stabilize relative positions of the desk legs (200) and the crossbeam (100) through first locking parts; and two brackets (300) disposed at the two ends of the crossbeam (100), and fixed to the crossbeam (100) through second locking parts, wherein when the adjustable desk needs to be assembled or disassembled, the first locking parts and the second locking parts are removed to allow the two desk legs (200) to rotate towards or opposite to each other to complete assembly or disassembly of the adjustable desk;

the two desk legs (200) are cross-stacked in an initial state;

the first locking parts overlap with the second locking parts after the adjustable desk is assembled.

2. The adjustable desk easy to disassemble according to claim 1, wherein first locking holes (110) are formed in the crossbeam (100), second locking holes (310) are formed in the brackets (300), and screws (210) are screwed on the desk legs (200); the first locking holes (110) are matched with the screws (210) to form the first locking parts between the crossbeam (100) and the desk legs (200), and the second locking holes (310) are matched with the screws (210) to form the second locking parts between the brackets (300) and the crossbeam (100).

3. The adjustable desk easy to disassemble according to claim 2, wherein an end of each said first locking hole (110) and an end of each said second locking hole (310) are open, and another end of each said first locking hole (110) and another end of each said locking hole (310) are closed; and after the adjustable desk is assembled, the first locking holes (110) and the second locking holes (310) are open towards the desk legs (200).

4. The adjustable desk easy to disassemble according to claim 2, wherein corners of the crossbeam (100) are wrapped in the brackets (300), and the second locking holes (310) are farther away from the desk legs (200) than the first locking holes (110) and are counter bores.

5. The adjustable desk easy to disassemble according to claim 4, wherein each said bracket (300) comprises a horizontal plate (320) and a vertical plate (330), the horizontal plates (320) are inserted into and matched with the crossbeam (100), and the second locking holes (310) are located in the vertical plates (330).

6. The adjustable desk easy to disassemble according to claim 5, wherein insertion plates (340) are mounted on the horizontal plates (320), guide slots (120) are formed in the crossbeam (100), and the insertion plates (340) are inserted into the guide slots (120) to enable the brackets (300) to be inserted into and matched with the crossbeam (100).

7. The adjustable desk easy to disassemble according to claim 6, wherein notches (180) allowing the horizontal plates (320) to be mounted therein are formed in openings of the guide slots (120).

8. The adjustable desk easy to disassemble according to claim 7, wherein connecting plates (170) are disposed at the two ends of the crossbeam (100), a side of each said connecting plate (170) is provided with a guide surface (171) and is connected to the corresponding slot (180), and another side of each said connecting plate (170) is formed with one said first locking hole (110); and after the insertion plates (340) are inserted into the guide slots (120) along the guide surfaces (171), the horizontal plates (320) are flush with a surface, away from the desk legs (200), of the crossbeam (100).

9. The adjustable desk easy to disassemble according to claim 1, wherein a mounting cavity (130) is formed in the crossbeam (100) in a lengthwise direction, and the two desk legs (200) are rotatably connected to two ends of the mounting cavity (130), respectively.

10. The adjustable desk easy to disassemble according to claim 9, wherein a motor housing (220) which is embedded in the mounting cavity (130) and rotatably connected to a cavity wall of the mounting cavity (130) is disposed at an end of each said desk leg (200); and the motor housings (220) are connected to the cavity wall of the mounting cavity (130) through pins (140), and the screws (210) are mounted on the motor housings (220).

11. The adjustable desk easy to disassemble according to claim 10, wherein adjusting holes (150) corresponding to the pins (140) in position are formed in the crossbeam (100).

12. The adjustable desk easy to disassemble according to claim 1, wherein the crossbeam (100) comprises a plurality of telescopic tubes (160), each of which is formed by bending a metal sheet, and every two adjacent said telescopic tubes (160) are detachably connected.

13. The adjustable desk easy to disassemble according to claim 12, wherein a reinforcing plate (190) is disposed at a joint of every two connected telescopic tubes (160), and closed ends of the reinforcing plates (190) are flush with planes where the horizontal plates (320) are located.

* * * * *